US005775292A

United States Patent [19]

Seeger

[11] Patent Number: 5,775,292

[45] Date of Patent: Jul. 7, 1998

[54] LOAD ADJUSTMENT DEVICE

[75] Inventor: Armin Seeger, Kelkheim, Germany

[73] Assignee: VDO Adolf Schindling AG, Frankfurt, Germany

[21] Appl. No.: 675,397

[22] Filed: Jul. 2, 1996

[30] Foreign Application Priority Data

Jul. 8, 1995 [DE] Germany ..... 195 24 941.0

[51] Int. Cl.[6] ..... F02D 11/10

[52] U.S. Cl. ..... 123/396

[58] Field of Search ..... 123/396, 399, 123/361, 400

[56] References Cited

U.S. PATENT DOCUMENTS 5,141,070 8/1992 Hickmann et al. ..... 180/197
5,148,790 9/1992 Hickmann et al. ..... 123/399
5,161,508 11/1992 Zentgraf et al. ..... 123/400

FOREIGN PATENT DOCUMENTS 3908596 9/1990 Germany .
4141104 6/1993 Germany .

*Primary Examiner*—Willis R. Wolfe
*Assistant Examiner*—Hieu T. Vo
*Attorney, Agent, or Firm*—Martin A. Farber

[57] ABSTRACT

A load adjustment device for an actuating member which determines the power of an internal combustion engine has a rotatably mounted stop lever (10) on a setting shaft (2). A torsion spring (13) is tensioned between said stop lever (10) and the setting shaft (2). A stop arm (14) of the stop lever (10) engages between an emergency-travel stop (11) and a minimum-load stop (15). For the swinging of the stop lever (10), there is provided a driver (12) which is arranged on an intermediate gear wheel (7) and drives a setting part (3) of the setting shaft (2), which part is developed as toothed segment.

9 Claims, 2 Drawing Sheets

LOAD ADJUSTMENT DEVICE

FIELD AND BACKGROUND OF THE INVENTION

The present invention relates to a load adjustment device for an actuator, developed in particular as a throttle valve, which is arranged on a setting shaft, the setting shaft being swingably driven by means of a reversible setting drive between a position of minimum load and a position of full load. The load adjustment device includes a prestressed return spring, developed as torsion spring, which urges the setting shaft in the direction of minimum load, and an emergency-travel spring by which the setting shaft can be moved in the direction of full load up to an emergency-travel position which is determined by an emergency-travel stop.

Load adjustment devices of the above type are known in general by the name "E-gas" for adjusting the power of the internal combustion engine of motor vehicles. In them, in order to minimize the consumption of fuel, the minimum-load is so designed that the internal combustion engine still just operates uniformly when idling. This has the result that it is not possible to produce a torque which is sufficient to move the motor vehicle in the position of minimum load. However, this may be necessary if the vehicle must be driven out of a region of danger but the load adjustment device can no longer be displaced by means of the accelerator pedal due to a failure of the control electronics system or of the setting drive. For this reason, in the known load adjustment devices there is provided, in addition to the return spring, an emergency-travel spring which provides that, in the event of failure of the control electronics or of the setting drive, the actuator is moved out of the position of minimum load positively into a emergency-travel position in which the internal combustion engine produces a sufficiently large torque to move the motor vehicle at low speed. This emergency-travel position is determined by a stop which is displaceable against the force of the return spring, against which stop a setting part is urged by means of the emergency-travel spring, wherein the stop can be displaced by the setting part against the force of the return spring when the setting part moves out of the emergency-travel position in the direction towards the position of full load.

The emergency-travel spring necessary in order to reach the emergency-travel position requires—aside from the cost—a corresponding amount of construction space and leads to an increase in the weight as compared with a load adjustment device without positive movement into an emergency-travel position in the event of a defect.

SUMMARY OF THE INVENTION

The object of the invention is so to develop a load adjustment device of the aforementioned type that it is as simple and compact in construction as possible and can be produced at the lowest possible cost.

This problem is solved in accordance with the invention by forming return spring and emergency-travel spring by a single torsion spring. One end of the torsion spring is firmly attached to a setting shaft and the other end of the torsion spring is firmly attached to a support part which is movable between a minimum-load stop and the emergency-travel stop. The support part is urged by the torsion spring in a direction towards the emergency-travel stop, and is adapted to be driven by the setting drive movable against the prestressing of the torsion spring from the emergency-travel stop in the direction towards the minimum-load stop.

By this construction, a single spring is used for two functions, namely, for moving the setting shaft from its position, of minimum-load into the emergency-travel position and for moving the setting shaft from its full-load position into the emergency-travel position. Therefore, it is possible to save a spring, as compared with the known load adjustment device, which leads to a reduction in cost and furthermore reduces the space required and the weight of the load adjustment device. These advantages are obtained without any sacrifice in the functionality and reliability in operation of the load adjustment device. Another advantage of the load adjustment device of the invention is that both the emergency-load position and the minimum-load position are unambiguously defined by stops fastened to the housing. Therefore, in contradistinction to an emergency-travel stop fixed in position merely by spring force, the emergency-load position and the minimum-load position can have a high and reproducible precision at only a slight manufacturing expense.

The support part can be developed in different ways. Its construction is particularly simple if it is a stop lever which is swingable around the axis of rotation of the setting shaft.

The construction of the load adjustment device is further simplified if, in accordance with another embodiment of the invention, the setting drive has a driver which, in the emergency-travel position, comes against the stop lever and moves it in the direction of the minimum-load stop.

Further simplification is attained in the load adjustment device if the setting part is firmly attached to the setting shaft, the setting shaft being swingably drivable via the setting part by the setting drive.

The double use of a single spring can take place in various ways. One advantageous embodiment of the invention is that the setting part is a toothed segment into which the setting drive engages by a gear wheel arranged on a shaft, and the driver is a cam rotating with the gear wheel. Such a load adjustment device differs only by a few, simple structural parts form the load adjustment devices heretofore customary, so that its manufacture requires only a slight additional expense. It is furthermore very compact and can be located in the protected gear space.

Optimal level ratios for actuation by motor result if the gear wheel is arranged fixed for rotation and coaxial to an intermediate gear wheel of larger diameter in which a drive pinion meshes, and via which intermediate gear wheel a stop lever engages with a swing arm. A cam is provided on the side of the intermediate gear wheel which is gripped over by the stop lever.

Still further simplification of the load adjustment device is attained, in accordance with another further development of the invention, by providing that the stop lever, in addition to its swing arm, has a stop arm which extends between an emergency-travel stop and a minimum-load stop.

The driver can be developed as pin or cam. Frictional losses upon the swinging of the stop lever are, however, particularly slight if the driver is developed as a roller which is mounted rotatably on the end surface of the intermediate gear wheel.

The torsion spring takes up particularly little space if it consists of a spiral spring.

The invention permits of numerous embodiments.

BRIEF DESCRIPTION OF THE DRAWING

With the above and other objects and other advantages in view, the present invention will become more clearly understood in connection with the detailed description of a preferred embodiment, when considered with the accompanying drawing of which.

DETAILED DESCRIPTION OF THE PREFERRED EMBODIMENT

Figure 1:
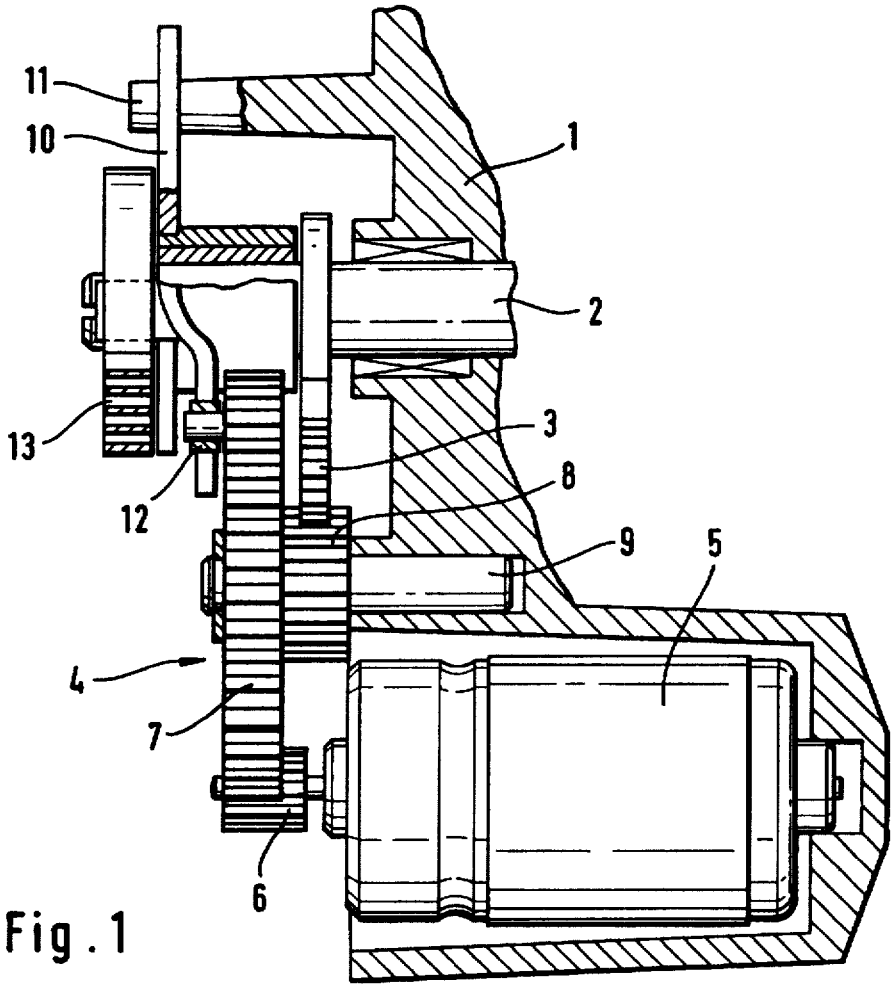
FIG. 1 is a section through a load adjustment device in accordance with the invention.

FIG. 1 shows a portion of a housing 1 of a throttle-valve connection. Within the housing 1 there is mounted a setting shaft 2, which may be a throttle-valve shaft on which a throttle valve (not shown) is arranged. Fixed for rotation on the setting shaft 2 there is a setting part 3 which is developed as toothed segment and which can be swung by means of a setting drive 4.

The setting drive 4 has a servo-motor 5 which can drive an intermediate gear wheel 7 via a drive pinion 6. This intermediate gear wheel 7 is mounted, together with a gear wheel 8, on a shaft 9. The gear wheel 8 is connected, fixed for rotation, with a intermediate gear wheel 7 and is in engagement with the toothing of the setting part 3 which is developed as a toothed segment.

On the setting shaft 2 a stop lever 10 is pivotably mounted, and rests in the position shown against an emergency-travel stop 11 which is fastened on the housing. The stop lever 10 can be swung by a driver 12 which extends axially from that end surface of the intermediate gear wheel 7 which faces the stop lever 10. The driver 12 is developed as an easily turnable roller. For a setting back of the setting shaft 2 in case of failure of the servo-motor 5, there is provided a torsion spring 13 which is developed as spiral spring in this embodiment, and which has one end fastened to the setting shaft 2 and its other end fastened to the stop lever 10.

Figure 2:
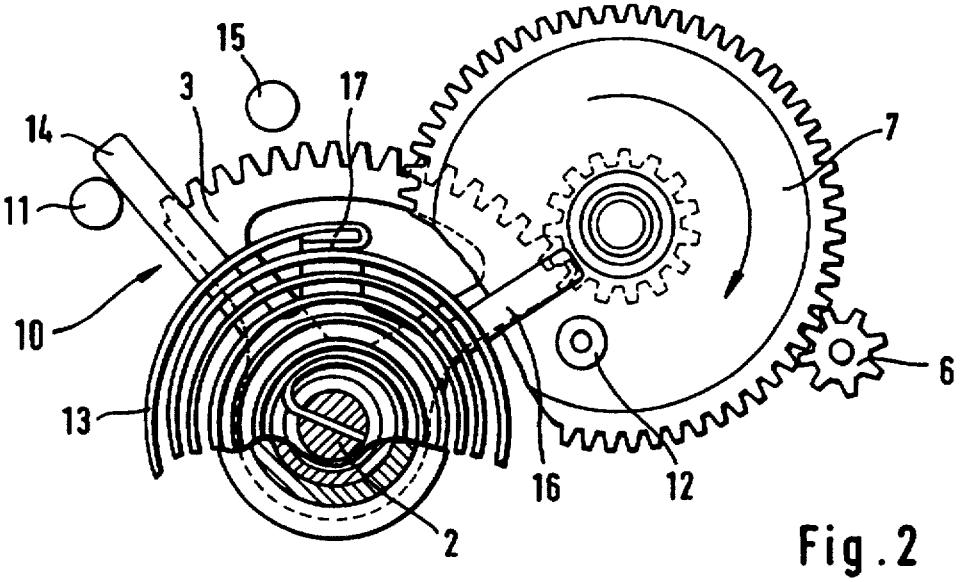
FIG. 2 is a side view, partially in section, of the load adjustment device in the full-load position.
Figure 3:
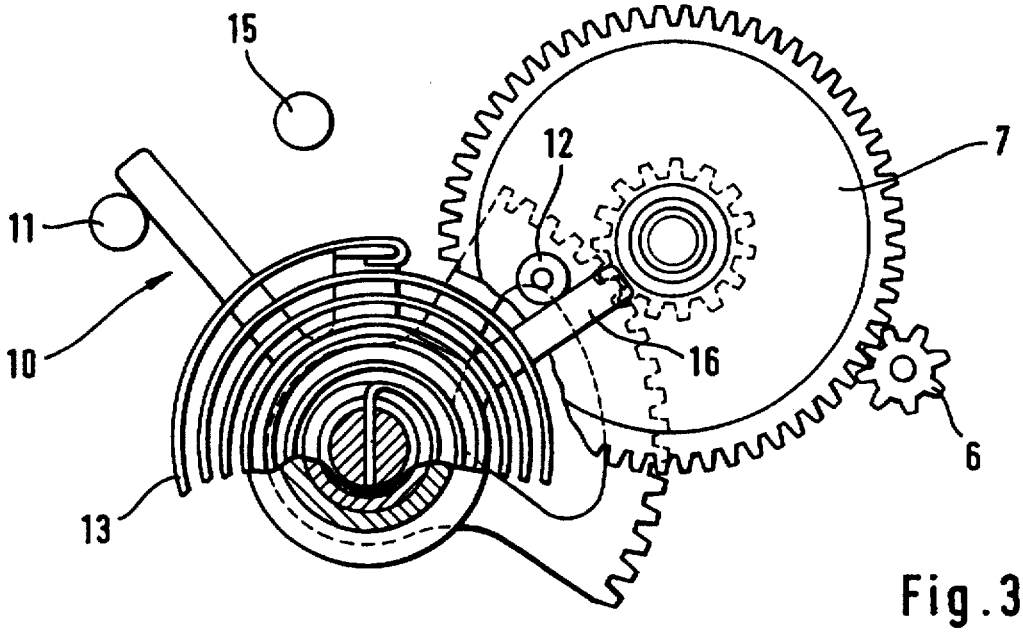
FIG. 3 is a side view, partially in section, of the load adjustment device in the emergency-travel position.
Figure 4:
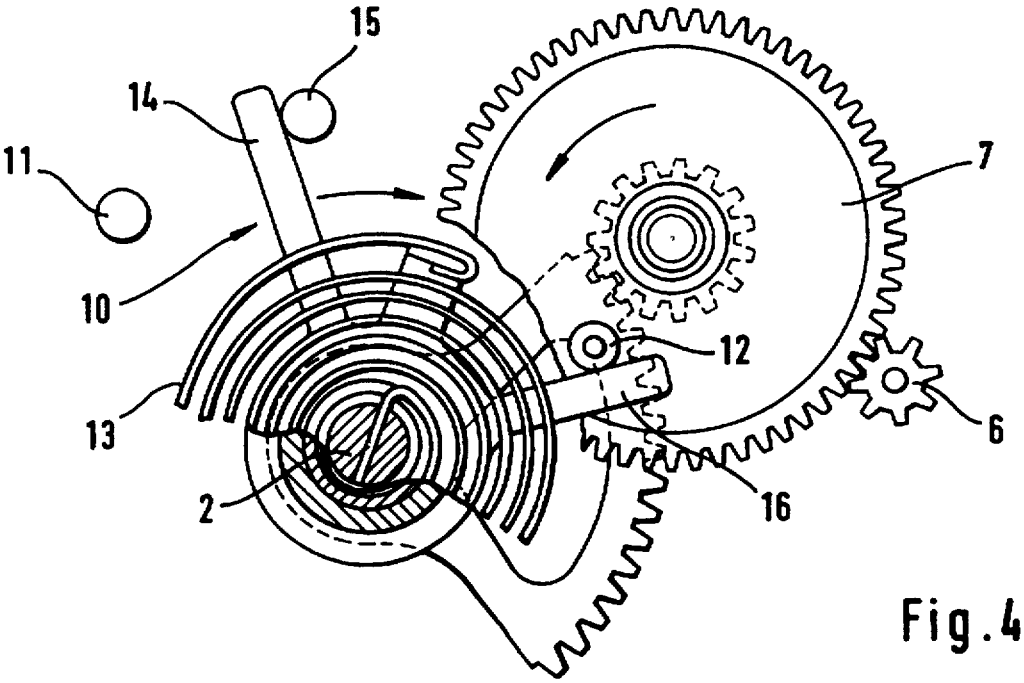
FIG. 4 is a side view, partially in cross section of the load adjustment device in minimum-load position.

The manner of operation of the load adjustment device of the invention can be noted from the following FIGS. 2, 3 and 4. FIG. 2 shows the full-load position of the load adjustment device. In this FIG. 2, it can be seen that the stop lever 10 which is rotatably mounted on the setting shaft 2 has a stop arm 14 which extends between the emergency-travel stop 11 and a minimum-load stop 15 which is also fastened to the housing. The stop lever 10 furthermore has a swing arm 16 which engages in part over the intermediate gear wheel 7 on which the driver 12 is arranged. In addition, the stop lever 10 has a short spring arm 17 to which the outer end of the torsion spring 13 is fastened. In this way, the stop lever 10 is urged in counterclockwise direction so that it rests against the emergency-travel stop 11 in the position shown in FIG. 2.

If the intermediate gear wheel 7 is turned in counterclockwise direction from the position shown in FIG. 2, the setting part 3 swings increasingly in clockwise direction, and therefore towards the right in FIG. 2, in which connection the position of the stop lever 10 at first remains unchanged. When the emergency-travel position shown in FIG. 3 has been reached, the driver 12 of the intermediate gear wheel 7 comes against the swing arm 16 of the stop lever 10. This emergency-travel position, shown in FIG. 3, is positively reached by the force of the torsion spring 13 if the servo-motor 5 shown in FIG. 1 is without electric current.

If the power upon idling is to be further reduced, then the intermediate gear wheel 7 must be turned further in counterclockwise direction as compared with FIG. 3 by means of the drive pinion 6. Since the driver 12 rests against the swing arm 16 of the stop lever 10 in the emergency-travel position, the stop lever 10 is swung against the force of the torsion spring 13 upon additional turning of the intermediate gear wheel 7 until the stop arm 14 comes against the minimum-load stop 15. During this swinging movement, the torsion spring 13 has a tendency to swing the stop lever 10 back into the position shown in FIG. 3, and thus also to swing the setting shaft 2 back into the emergency-travel position.

I claim:

1. A load adjustment device for a setting member which determines the power of an internal combustion engine, the load adjustment device comprising:

a setting shaft which supports the setting member, the setting member being a throttle valve;

a reversible setting drive, said setting shaft being drivable pivotally by means of said reversible setting drive between a minimum-load position and a full-load position;

a minimum-load stop, an emergency-travel stop, and a prestressed return spring developed as torsion spring which urges the setting shaft in a direction toward minimum-load, said torsion spring serving also as an emergency-travel spring by which the setting shaft is movable in a direction toward full load up to an emergency-travel position determined by said emergency-travel stop;

wherein one end of said torsion spring is firmly attached to said setting shaft, and a second end of said torsion spring is firmly attached to a support part movable between said minimum-load stop and said emergency-travel stop;

said support part is urged by said torsion spring in the direction towards said emergency-travel stop, and is drivable by said setting drive which is movable against an initial tension of said torsion spring from said emergency-travel stop in the direction towards said minimum-load stop.

2. A load adjustment device according to claim 1, wherein the support part is a stop lever which is swingable around an axis of rotation of the setting shaft.

3. A load adjustment device according to claim 1, wherein said torsion spring is a spiral spring.

4. A load adjustment device A load adjustment device for a setting member which determines the power of an internal combustion engine, the load adjustment device comprising:

a setting shaft which supports the setting member, the setting member being a throttle valve;

a reversible setting drive, said setting shaft being drivable pivotally by means of said reversible setting drive between a minimum-load position and a full-load position;

a minimum-load stop, an emergency-travel stop, and a prestressed return spring developed as torsion spring which urges the setting shaft in a direction toward minimum-load, said torsion spring serving also as an emergency-travel spring by which the setting shaft is movable in a direction toward full load up to an emergency-travel position determined by said emergency-travel stop;

wherein one end of said torsion spring is firmly attached to said setting shaft, and a second end of said torsion spring is firmly attached to a support part movable between said minimum-load stop and said emergency-travel stop;

said support part is urged by said torsion spring in the direction towards said emergency-travel stop and is drivable by said setting drive which is movable against an initial tension of said torsion spring from said emergency-travel stop in the direction towards said minimum-load stop;

the support part is a stop lever which is swingable around an axis of rotation of the setting shaft; and said setting drive has a drive which, in the emergency-travel position, comes against said stop lever and moves said stop lever in the direction towards said minimum-load stop.

5. A load adjustment device according to claim 4, wherein said setting drive includes a setting part firmly attached to said setting shaft, said setting shaft being swingably drivable via said setting part by said setting drive.

6. A load adjustment device according to claim 5, further comprising:

a second shaft, and a gear wheel mounted to said second shaft;

wherein said setting part is a toothed segment by which said setting drive engages said gear wheel; and said drive is a cam which rotates with said gear wheel.

7. A load adjustment device according to claim 6, wherein said gear wheel is a first gear wheel, said load adjustment device further comprising an intermediate gear wheel supported by said second shaft, and a drive pinion;

wherein said first gear wheel is arranged, fixed for rotation and coaxial to said intermediate gear wheel;

said intermediate gear wheel has a larger diameter than said first gear wheel, and meshes with said drive pinion;

said stop lever has a swing arm which engages with said intermediate gear wheel; and said drive is located on a common side of said intermediate gear wheel with said stop lever for engagement with said swing arm.

8. A load adjustment device according to claim 7, wherein said driver comprises a roller which is rotatably mounted on an end surface of said intermediate gear wheel.

9. A load adjustment device for a setting member which determines the power of an internal combustion engine, the load adjustment device comprising;

a setting shaft which supports the setting member, the setting member being a throttle valve;

a reversible setting drive, said setting shaft being drivable pivotally by means of said reversible setting drive between a minimum-load position and a full-load position;

a minimum-load stops, an emergency-travel stop, and a prestressed return spring developed as torsion spring which urges the setting shaft in a direction toward minimum-load, said torsion spring serving also as an emergency-travel spring by which the setting shaft is movable in a direction toward full load up to an emergency-travel position determined by said emergency-travel stop;

wherein one end of said torsion spring is firmly attached to said setting shaft, and a second end of said torsion spring is firmly attached to a support part movable between said minimum-load stop and said emergency-travel stop;

said support part is urged by said torsion spring in the direction towards said emergency-travel stop and is drivable by said setting drive which is movable against an initial tension of said torsion spring from said emergency-travel stop in the direction towards said minimum-load stop;

the support part is a stop lever which is swingable around an axis of rotation of the setting shaft; and said stop lever has a stop arm and a swing arm, and extends between said emergency-travel stop and said minimum load stop.

* * * * *